United States Patent [19]

Shani

[11] 4,037,272

[45] July 26, 1977

[54] RECIPE APRON

[76] Inventor: Esther G. Shani, 1670 Huntington Drive, South Pasadena, Calif. 91030

[21] Appl. No.: 688,419

[22] Filed: May 20, 1976

[51] Int. Cl.[2] ..... A41D 13/04

[52] U.S. Cl. ..... 2/48; 40/19.5

[58] Field of Search ..... 2/46, 48, 1; 40/129 A, 40/19.5, 21 C

[56] References Cited

U.S. PATENT DOCUMENTS

| | | | |
|---|---|---|---|
| 1,619,893 | 3/1927 | Stoer | 40/19.5 X |
| 3,055,133 | 9/1962 | Anderson | 40/129 A |
| 3,166,863 | 1/1965 | Gray | 40/19.5 X |
| 3,624,686 | 11/1971 | Beals | 2/48 X |
| 3,879,762 | 4/1975 | Herman | 2/48 |

*Primary Examiner*—Alfred R. Guest

*Attorney, Agent, or Firm*—Spensley, Horn & Lubitz

[57] ABSTRACT

A recipe apron comprising a plurality of rings attached to the apron, a plurality of recipe sheets hanging from the rings and a plurality of transparent cover sheets attached to the apron such that the recipe sheets can be flipped through and the recipe sheets are held in place and protected from stains. Each of the recipe sheets has a recipe printed thereon and the recipes are grouped on the rings according to subject.

6 Claims, 4 Drawing Figures

Fig. 1
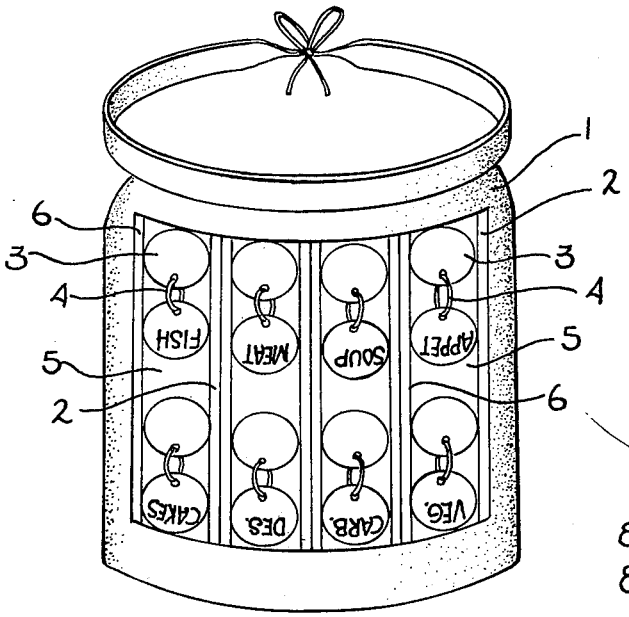
Fig. 2
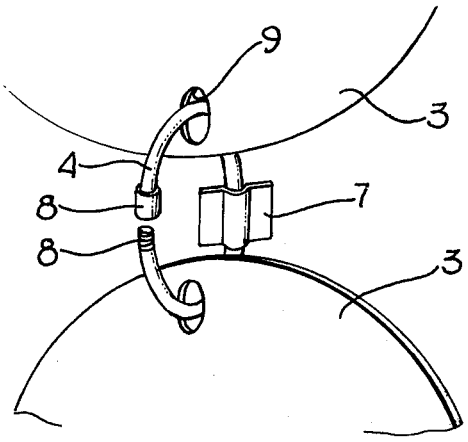
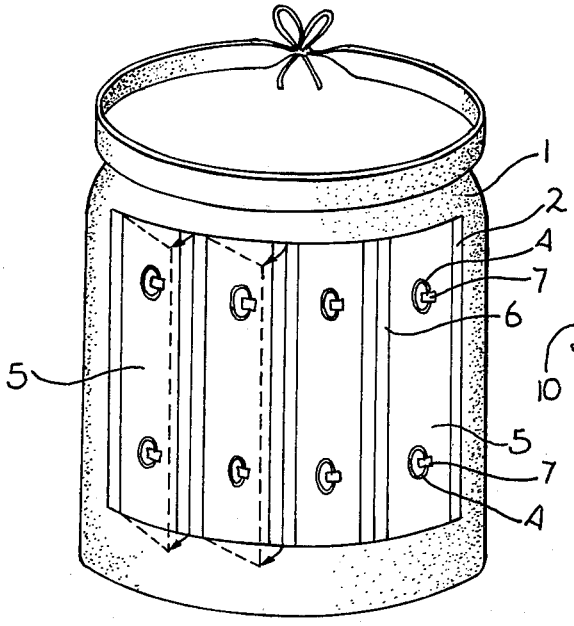
Fig. 3
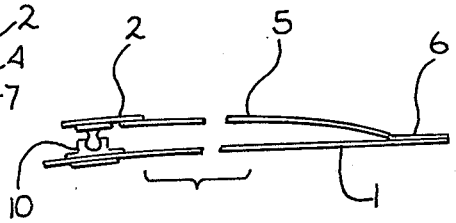
Fig. 4

RECIPE APRON

FIELD OF INVENTION

This invention relates to cooking aids and more particularly to an article of apparel equipped to hold recipes.

DESCRIPTION OF THE PRIOR ART

While cooking it is frequently necessary to utilize a recipe which is either contained in a recipe book or on single card. During the preparation of the meal being made pursuant to the recipe, it is frequently necessary to refer back to the recipe. To refer back to the recipe, the cook must return to that place where the recipe is and look at the recipe. In the situations where one is using a cookbook, the cookbook frequently closes or the page flips requiring the cook to flip through the book to find the right recipe again. When cooking pursuant to a recipe, several difficulties are encountered. Firstly, one must always return to the place where the recipe is located thereby wasting time and steps. Secondly, the recipe book becomes stained due to the handling of the recipe book by the cook. Thirdly, if the cook is using more than one recipe, the cook must flip back and forth through the recipe book between the recipes.

Accordingly, it is a general object of the present invention to provide a recipe apron on which are attached the recipes that the cook intends to utilize in preparing the courses of a single meal.

It is another object of the present invention to provide a recipe apron with recipes attached thereto so that the cook can simultaneously observe all the recipes of the several courses of the meal being prepared without having to flip through the pages of a recipe book.

It is yet another object of the present invention to provide a recipe apron which protects the recipes from being stained during the preparation of the meal.

SUMMARY OF THE INVENTION

In keeping with the principals of the present invention, the objects are accomplished by a unique recipe apron comprising a plurality of rings attached to the apron in rows and columns and a plurality of recipe sheets hanging from the rings. On the recipe sheets are printed recipes and the recipe sheets hanging on the rings are grouped according to subject. Furthermore, a plurality of transparent cover sheets are attached to the apron such that they can be partially removed to allow the cook to flip through the recipe sheets and hold the recipe sheets in place and protect then from stains. In operation, the transparent sheets are temporarily disconnected along one edge from the recipe apron and the recipe sheets are flipped through on the individual rings to determine the recipes to be used for the courses of the meal to be prepared. After the proper recipes are selected, the transparent sheets are again fastened to the apron so as to hold the recipes selected in place and to protect the recipes from being soiled.

BRIEF DESCRIPTION OF THE DRAWINGS

The above mentioned and other features and objects of the present invention will become more apparent by reference to the following description taken in conjunction with the accompanying drawings wherein like reference numerals denote like elements, and in which:

FIG. 1 is a perspective view of a recipe apron in accordance with the teachings of the present invention;

FIG. 2 is an enlarged partial view of the ring and recipe sheets on the recipe apron of FIG. 1;

FIG. 3 is a perspective view of a recipe apron illustrating the rings and protective transparent sheets; and FIG. 4 is a sectional view of the recipe apron of FIG. 3 taken along a horizontal line passing through a snap.

DESCRIPTION OF THE PREFERRED EMBODIMENT

Referring to the Figures, shown therein is a recipe apron in accordance with the teachings of the present invention. The recipe apron includes an apron 1 having rings 4 attached thereto by small pieces of cloth 7 stitched to the apron 1. The rings 4 can be opened and closed with a screw 8 and recipe sheets 3 are attached to the rings 4 by inserting the ring 4 through a hole 9 in the recipe sheets 3. Transparent protective sheets 5 are permanently fixed to the apron 1 along one edge 6. The other edge 2 of protective sheets 5 is detachably coupled to the apron 1 by snaps 10 or the like.

In practice the recipe sheets can be made from paper, plastic or any stiff material onto which one can print, write, or emboss a recipe. Furthermore, the recipes printed on the recipe sheets 3, are printed upside down so that the cook wearing the apron can easily read the recipe. Also the rings may be made of plastic or any suitable metal and may be opened and closed by any means. In addition the rings may be fastened to the apron by small pieces of plastic material which are glued to the apron. In addition the apron itself may be made out of plastic. Also, the transparent protective sheets can be made from any transparent material such as a transparent plastic.

To use the recipe apron, one first detaches the protective sheets along the edge 2 and opens them up so that the cook can flip through the recipes on the recipe sheets 3. After the cook has selected the proper recipes for each of the courses of the meal, the transparent sheets are then reattached along the edge 2 thereby covering the recipe sheets and protecting them from being stained.

In conclusion, the recipe apron in accordance with the teachings of the present invention is an arrangement of recipes on an apron in such a way that the user can flip through the recipes and determine a meal by changing from a plurality of different meal courses. The cook can carry all the recipes with him or her without going back and forth for the recipe and leaving the hands free for dealing with ingredients and kitchen utensils. Furthermore, since all the recipes are located on the apron, the cook can choose simultaneously different courses compatible to each other.

In all cases it is understood that the above described embodiment is purely illustrative of but one of the many possible specific embodiments which represent the applications of the principals of the present invention. Furthermore, numerous and varied other arrangements can be readily devised in accordance with the principals of the present invention by those skilled in the art without departing from the spirit and scope of the invention.

I claim:

1. A recipe apron comprising:

an apron;

a plurality of rings coupled to said apron;

a plurality of recipe sheets coupled to said rings; and a plurality of transparent cover sheets extending over said recipe sheets, each of said transparent cover sheets, being fixed along one edge thereof to said apron and being detachably coupled along the other edge thereof to said apron whereby said cover sheets may be detached along one edge to allow a user to flip through the recipe sheets and reattach to said apron thereby holding said recipe sheets in place and protecting said recipe sheets from stains.

2. A recipe apron according to claim 1 wherein recipes are provided on said recipe sheets and said recipe sheets are grouped on said ring according to subject.

3. A recipe apron according to claim 2 wherein said recipes are provided upside down on said recipe sheets.

4. A recipe apron according to claim 3 wherein said rings are coupled to said apron by small pieces of cloth sewn onto said apron.

5. A recipe apron according to claim 4 wherein said cover sheets are detachably coupled along one edge to said apron by snaps.

6. A recipe apron according to claim 5 wherein said cover sheets are made from transparent plastic.

* * * * *